US006436158B1

(12) United States Patent
Fujikawa et al.

(10) Patent No.: US 6,436,158 B1
(45) Date of Patent: Aug. 20, 2002

(54) COAL REFORMING PROCESS AND APPARATUS THEREFOR

(75) Inventors: Keiji Fujikawa; Setsuo Omoto; Hisao Yamaguchi, all of Hiroshima (JP)

(73) Assignee: Mitsubishi Heavy Industries Ltd., Tokyo (JP)

( * ) Notice: Subject to any disclaimer, the term of this patent is extended or adjusted under 35 U.S.C. 154(b) by 0 days.

(21) Appl. No.: 09/300,188

(22) Filed: Apr. 27, 1999

(30) Foreign Application Priority Data

Apr. 30, 1998 (JP) ..... 10-120687

(51) Int. Cl.[7] ..... C10L 9/06; C10L 5/00
(52) U.S. Cl. ..... 44/620; 44/608; 44/592
(58) Field of Search ..... 44/620

(56) References Cited

U.S. PATENT DOCUMENTS 4,211,174 A * 7/1980 Martin et al. ..... 110/263
4,226,698 A * 10/1980 Schroeder ..... 208/8 R
4,259,083 A * 3/1981 Ignasiak ..... 44/1 F
4,401,436 A 8/1983 Bonnecaze ..... 44/1 G
4,493,157 A * 1/1985 Wicker ..... 34/10
4,788,360 A * 11/1988 Calemma et al. ..... 562/465
5,112,501 A * 5/1992 Rausa et al. ..... 210/730
5,324,336 A * 6/1994 Child ..... 44/608
5,464,605 A * 11/1995 Hayden ..... 423/579
5,504,050 A * 4/1996 Hayden ..... 502/180
5,863,304 A * 1/1999 Viall et al. ..... 44/626
5,919,277 A * 7/1999 Reeves et al. ..... 44/501

FOREIGN PATENT DOCUMENTS

JP 60065097 4/1985 ..... C10L/9/00
JP 630003097 1/1988 ..... C10L/9/08

* cited by examiner

*Primary Examiner*—Ellen M. McAvoy
(74) *Attorney, Agent, or Firm*—Anderson Kill & Olick; Eugene Lieberstein; Michael N. Meller

(57) ABSTRACT

As one of the coal reforming treatment steps constituting a coal reforming process, an oxidation treatment step is carried out on a circular grate. For this purpose, there is used a coal reforming apparatus comprising a circular grate, the circular grate being separated into a plurality of zones which include fixed bed zones and mixing zones for fluidizing the coal properly between adjacent fixed bed zones.

13 Claims, 3 Drawing Sheets

COAL REFORMING PROCESS AND APPARATUS THEREFOR

BACKGROUND OF THE INVENTION

1. Field of the Invention

This invention relates to a process for the oxidation treatment of coal, particularly low-grade coal (or low-quality coal) having a high moisture content, and an apparatus therefor.

2. Description of the Related Art

Low grade coal such as brown coal and subbituminous coal are found in abundance, but they have a high moisture content. Accordingly, their calorific value per unit weight is low, their transportation is uneconomical, and their reactivity is so high that they are liable to spontaneous combustion during storage or transportation. Owing to these problems, they are not positively utilized at present. In order to utilize such low-grade coal effectively, a variety of reforming processes have been proposed.

As a process for reforming coal having a high moisture content by dehydration and heating, there has been proposed a coal reforming process wherein coal is loaded on a rotatable annular moving grate (hereinafter referred to as "circular grate"), heated by supplying the coal bed with a hot gas having an oxygen concentration of not greater than 5%, cooled to a temperature lower than its ignition point by passing a cooling gas having an oxygen concentration of not greater than 5% through the coal bed, and then discharged (Japanese Patent Publication No. 5-66434). This patent discloses an exemplary coal reforming apparatus in which its internal space is partitioned into zones and different heat treatments such as drying, carbonization and cooling are carried out in the zones. However, no mentioned is made of the use of this apparatus for carrying out an oxidation treatment.

When low-grade coal is reformed by a dehydration and heating treatment, it exhibits high activity (i.e., spontaneous combustibility). In order to prevent spontaneous combustion of such reformed coal, it is usually subjected to an oxidation treatment. Generally, this process for reforming low-grade coal comprises the steps of subjecting low-grade coal to a dehydration and heating treatment so as to remove the moisture contained therein and thus increase its calorific value per unit weight, subjecting the coal to an oxidation treatment for the purpose of minimizing its spontaneous combustibility, and subsequently cooling the coal to a temperature lower than its ignition point.

For example, a process for the oxidation treatment of coal by using an apparatus illustrated in FIG. 3 has been proposed in the prior art (Japanese Patent Publication No. 4-29715). Specifically, coal is fed to the upper part of the tank through a line 66 and allowed to fall by gravity, while air is supplied to air distributors 70 having air injection nozzles through a line 68, and injected into the lower part of the tank from an air outlet. Thus, the oxidation treatment of coal is carried out by bringing the coal into counterflow contact with air while regulating the residence time of the coal in the tank.

However, in the conventional process wherein coal is subjected to an oxidation treatment in a fluidized state as illustrated in FIG. 3, the coal is pulverized owing to the collision of coal pieces and the collision of coal pieces with the wall surfaces and internal parts of the tank, so that a large amount of coal dust is produced. This coal dust poses a problem because it fouls the apparatus by adhering to its internal surfaces and causes a clogging in the apparatus and piping. Moreover, the coal dust not only imposes a considerable load on attachment devices such as cyclone, but also reduces the yield of the product.

SUMMARY OF THE INVENTION

An object of the present invention is to provide a coal reforming process wherein an oxidation treatment is carried out without producing coal dust, and a coal reforming apparatus therefor.

In a coal reforming process comprising a series of steps including the aforesaid dehydration and heating treatment step and the aforesaid oxidation treatment step, the present invention relates to an improved oxidation treatment method for reducing the spontaneous combustibility of coal and an apparatus therefor.

That is, the present invention provides a coal reforming process wherein, as one of the coal reforming treatment steps, an oxidation treatment step is carried out on a circular grate.

In the process of the present invention, the circular grate may be separated into a plurality of zones, and the reaction rate may be controlled by independently regulating the temperature, flow rate and oxygen concentration of a gas passed through each of the separated zones.

Moreover, in the practice of the present invention, there may be used a coal reforming apparatus comprising a circular grate, the circular grate being separated into a plurality of zones which include fixed bed zones and mixing zones for fluidizing the coal properly between adjacent fixed bed zones.

This coal reforming apparatus may further comprise means for independently regulating the temperature, flow rate and oxygen concentration of a gas passed through each of the separated zones.

Furthermore, in the coal reforming process of the present invention, there may be used a rotatable circular grate equipped with an enclosed space having a plurality of zones. In this case, the oxidation treatment of coal with a heated gas is carried out in a first zone, and the coal is uniformly dispersed and mixed in a second zone.

In a preferred embodiment, the aforesaid circular grate is equipped with two or more enclosed spaces, and the aforesaid oxidation treatment step and the aforesaid dispersing and mixing step are repeated two or more times.

The aforesaid heated gas may be supplied either from below the coal bed or from above the coal bed.

According to the present invention, an efficient oxidation treatment step can be carried out in a coal reforming process, without causing powdering or temperature variation during heating. Moreover, heat generation can be controlled by defining a plurality of oxidation treatment zones and supplying them with heated gases having different temperatures, flow rates and oxygen concentrations.

The present invention can produce the following effects.

(1) As contrasted with the prior art, most of the oxidation treatment step for coal is carried out in a fixed bed (i.e., a non-fluidized bed). This can minimize powdering of coal due to the collision of coal pieces or the collision of coal pieces with the internal surfaces of the apparatus, and thereby prevent a reduction in the yield of the product.

(2) The form of a coal bed may comprise a combination of a fixed bed and a fluidized bed, so that the coal treated in a fixed bed can be fluidized and mixed properly. This can make uniform the temperature distribution occurring chiefly in the thickness direction of the coal bed and thereby prevent the formation of hot spots.

(3) It is possible to define a plurality of oxidation treatment zones and supply them with heated gases having different temperatures, flow rates and oxygen concentrations. This can accelerate the oxidation reaction and thereby reduce the time required for the oxidation treatment, while controlling heat generation due to the adsorption of oxygen to coal.

(4) The feed rate of a heated gas may be increased by supplying it from not only bellow the coal bed but also above the bed, so that the heat generated by the oxidation of coal can be removed rapidly. This can increase the thickness of the coal bed and thereby improve the throughput of the apparatus or make the apparatus more compact.

DETAILED DESCRIPTION OF THE PREFERRED EMBODIMENT

According to the present invention, coal comprising brown coal, subbituminous coal, lignite, or a mixture thereof, particularly low-quality coal, can be reformed by subjecting it to an oxidation treatment after a dehydration and heating step. Low-quality coal includes various types of coal having a calorific value of not greater than 4,000 kcal/kg, a moisture and water content of not less than 30%, an ash content of not less than 40%, and a volatile content of not greater than 10%, and the present invention may be applied to any coal that is commonly called "low-quality coal". The coal which has been reformed according to the present invention may be used as general purpose coal, boiler coal, gas producer coal, coking coal and the like.

Figure 1:
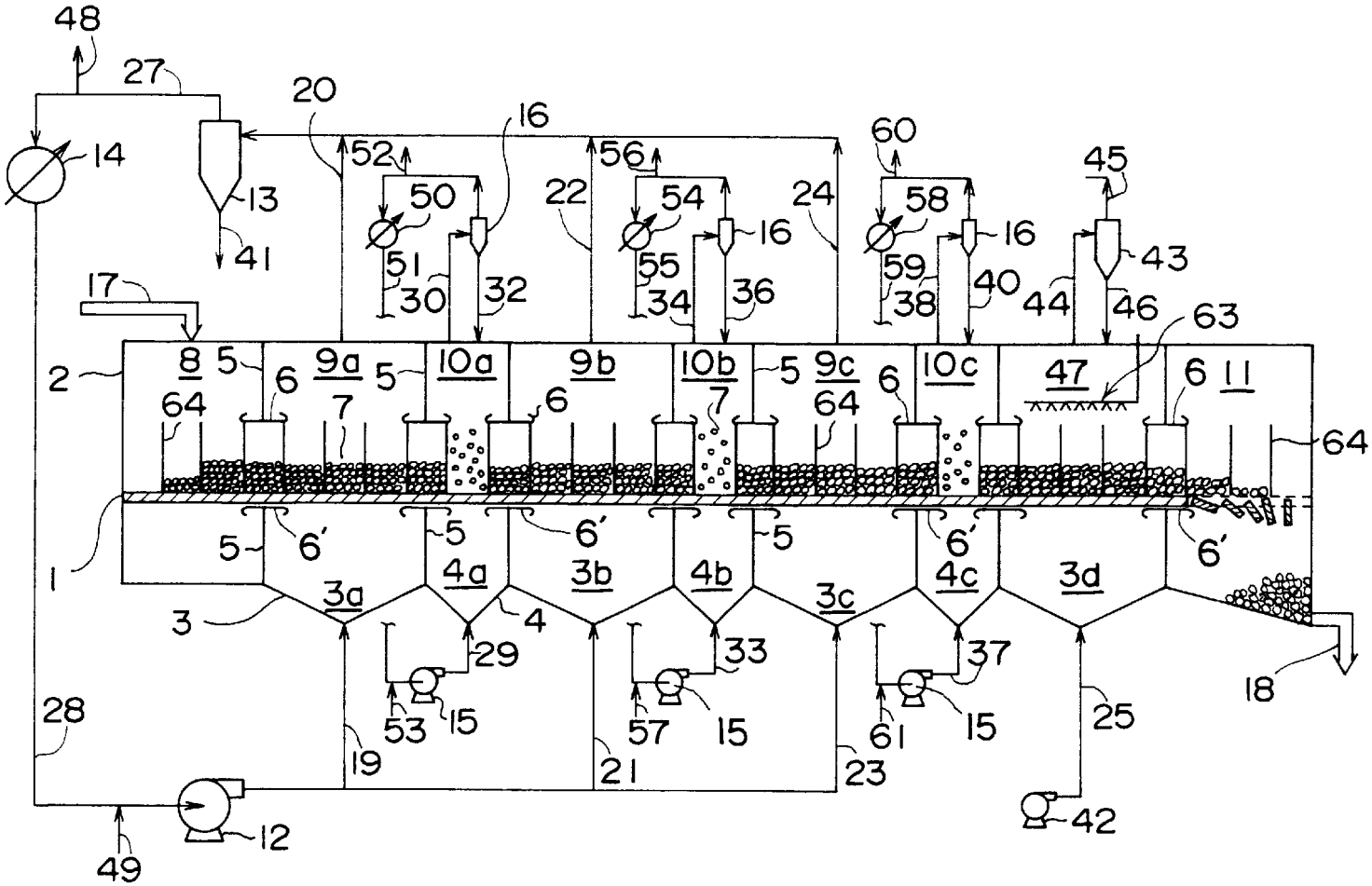
FIG. 1 is a development of a circular grate for the oxidation treatment of coal on which the coal reforming process of the present invention is carried out.

FIG. 1 is a development illustrating the construction of an exemplary circular grate for carrying out the oxidation treatment of coal having undergone a dehydration and heating treatment. Grade 1 has the shape of a ring and is rotated in a horizontal plane by means of a driving mechanism (not shown). A fixed hood 2 is disposed on the upper side of grate 1, while fixed wind boxes 3 and 4 are disposed on the lower side thereof. Moreover, zone separating walls 5 and 5' divide the internal space of hood 2 into a plurality of zones corresponding to wind boxes 3 and 4. Partitions 64 are installed together grate 1 thereon, and interzone gas seals 6 are disposed on the bottom end of upper separating walls 5 so as to be in contact with the top ends of partitions 64 corresponding to zone separating walls 5.

On the lower side of grate 1, interzone gas seals 6' are similarly disposed on the top ends of upper zone separating walls 5 so that the fluids flowing through the respective zones will not mix with each other. Moreover, additional partitions 64 extending in the width direction of grate 1 are longitudinally installed at appropriate intervals so that the coal bed may be fluidized only in coal mixing zones as will be described later. In other zones, such additional partitions 64 may be installed at appropriate intervals or may be omitted.

In a feed zone 8, coal 17 having a temperature of about 160° C. as a result of heating treatment is loaded onto grate 1 to a thickness of 10 to 900 mm and preferably 50 to 500 mm, and conveyed to an oxidation treatment zone 9*a* where it is oxidized with a heated gas 19 supplied from wind box 3*a*. Subsequently, in a mixing zone 10*a*, the coal bed 7 is uniformly dispersed or mixed with a heated gas supplied from the corresponding wind box 4*a*.

Thereafter, the same procedure is repeated in oxidation treatment zones 9*a* and 9*c*, and mixing zones 10*b* and 10*c*. The residence time of coal in each of oxidation treatment zones 9*a*, 9*b* and 9*c* is in the range of about 2 to 20 minutes.

When the thickness of coal bed 7 laid on grate 1 is sufficiently small and the temperature difference in the thickness direction of coal bed 7 is sufficiently small, mixing zones 10*a*, 10*b* and 10*c* are unnecessary. In such a case, mixing zones 10*a*, 10*b* and 10*c* may be used as oxidation treatment zones. The manner of division into zones by means of zone separating walls 5 is not limited to the above-described case in which three oxidation treatment zones and three mixing zones are alternately formed, but the number of zones may be increased or decreased arbitrarily.

Subsequently, the coal having undergone the oxidation treatment is conveyed to a cooling zone 47 where it is cooled to the vicinity of room temperature by means of a cooling gas supplied from the corresponding wind box 3*d*, and then discharged out of the system by way of a discharge zone 11.

Heated gases 19, 21 and 23 supplied to the aforesaid oxidation treatment zones comprise an inert gas, air, or combustion gas obtained by burning a fuel with air, and are adjusted to a temperature of 100 to 200° C., preferably 120 to 180° C., and an oxygen concentration of 1 to 21% by volume, preferably 1 to 10% by volume. These heated gases 19, 21 and 23 are supplied from below coal bed 7 laid on the grate by way of wind boxes 3*a*, 3*b* and 3*b* of oxidation treatment zones 9*a*, 9*b* and 9*c*, respectively, and passed therethrough at a flow rate which allows coal bed 7 laid on the grate to remain in the form of a fixed bed (i.e., a substantially non-fluidized bed). Generally, a heated gas having a higher temperature and a higher oxygen concentration can accelerate the oxidation reaction and thereby reduce the time required for the oxidation treatment. However, if the temperature of coal exceeds about 200° C. owing to the heat generated by the oxidation reaction, large amounts of CO and $CO_2$ will be produced. Consequently, the temperatures, flow rates and oxygen concentrations of heated gases 19, 21 and 23 supplied to the oxidation treatment step need to be controlled according to the temperature of coal 17 fed from the dehydration and heating treatment step.

Moreover, the reactivity of coal 17 fed to the oxidation treatment step is highest in feed zone 8, and becomes lower as the oxidation treatment proceeds. Accordingly, in order to reduce the treating time, it is effective to install a heat exchanger, a blower and an oxygen feeder (not shown) in the line for supplying a heated gas to each of the oxidation treatment zones defined by zone separating walls 5, and thereby control the temperature, flow rate and oxygen concentration of the heated gas. Alternatively, the heated gas may be supplied from above coal bed 7. While the flow rate of the heated gas supplied from below coal bed 7 is limited so as not to cause fluidization thereof, the heated gas supplied from above coal bed 7 is not subject to such limitation.

The gases leaving oxidation treatment zones 9*a*, 9*b* and 9*c* are conducted through exhaust pipes 20, 22 and 24, and introduced into a cyclone 13 where finely powdered coal 41 is recovered. Thereafter, the gas is conducted through a pipeline 27, passed through a heat exchanger 14 where it is cooled to a predetermined temperature, and then returned to the aforesaid circulating blower 12 through a pipeline 28. In order to keep the oxygen concentration of the gas constant, the above-described gas circulation line is provided with a purge line 48 and a make-up line 49.

Heated gases 29, 33 and 37 supplied to the aforesaid mixing zones for mixing the coal bed comprise an inert gas, air, or combustion gas obtained by burning a fuel with air, and are adjusted to a temperature of 100 to 200° C., preferably 120 to 180° C., and an oxygen concentration of 1 to 21% by volume, preferably 1 to 10% by volume. The flow rates of these gases are regulated so as to cause coal bed 7 laid on grate 1 to be mixed by a proper degree of fluidization. Thus, heated gases 29, 33 and 37 are supplied to coal bed 7 laid on grate 1 by way of wind boxes 4*a*, 4*b* and 4*c* of mixing zones 10*a*, 10*b* and 10*c*, respectively. The gases leaving the mixing zones are introduced into cyclones 16 installed above them through pipelines 30, 34 and 38, where finely powdered coal is recovered. Thereafter, the gases are passed through heat exchangers 50, 54 and 58 where they are cooled to a predetermined temperature, and then returned to the aforesaid circulating blower 15 through lines 51, 55 and 59. In order to control the oxygen concentrations of the gases, the above-described gas circulation lines are provided with purge lines 52, 56 and 60 and make-up lines 53, 57 and 61.

Cooling gas 25 supplied to the aforesaid cooling zone comprises an inert gas, air, humidified air, or combustion gas obtained by burning a fuel with air, and has a temperature of 150° C. or below and preferably 100° C. or below. Using a blower 42, this cooling gas 25 is supplied to coal bed 7 laid on grate 1 by way of wind box 3*d* of cooling zone 47. Although the flow rate of cooling gas 25 may be such that coal bed 7 is fluidized, it is preferable to employ a flow rate which does not cause fluidization of coal bed 7.

Alternatively, the aforesaid cooling gas 25 may be supplied from above coal bed 7. In this case, the flow rate of cooling gas 25 may be increased because it does not cause fluidization of coal bed 7. The gas leaving cooling zone 47 is conducted through an exhaust pipe 44 and introduced into a cyclone 43 where finely powdered coal is recovered.

Alternatively, in order to enhance cooling efficiency in cooling zone 47, water may be sprayed over the surface of coal bed 7 by means of a spray nozzle 47 instead of supplying cooling gas 25. In this case, the amount of water sprayed must be regulated so that the surfaces of the coal become dry before it reaches the discharge zone. Alternatively, more efficient cooling may be effected by the combined use of spray cooling with water and circulation of a cooling gas. After cooling, reformed coal 18 having undergone the oxidation treatment is recovered from discharge zone 11.

Reference numerals 32, 36, 40 and 46 designate coal particle withdrawal lines from cyclones 16 and 43 for collecting coal particles entrained by the heated gases from mixing zones 10*a*, 10*b* and 10*c* and cooling zone 47. These coal particles may be recovered as such, or may be returned to coal bed 7 as shown in FIG. 1. A exhaust gas 45 may be returned to blower 42.

Figure 2:
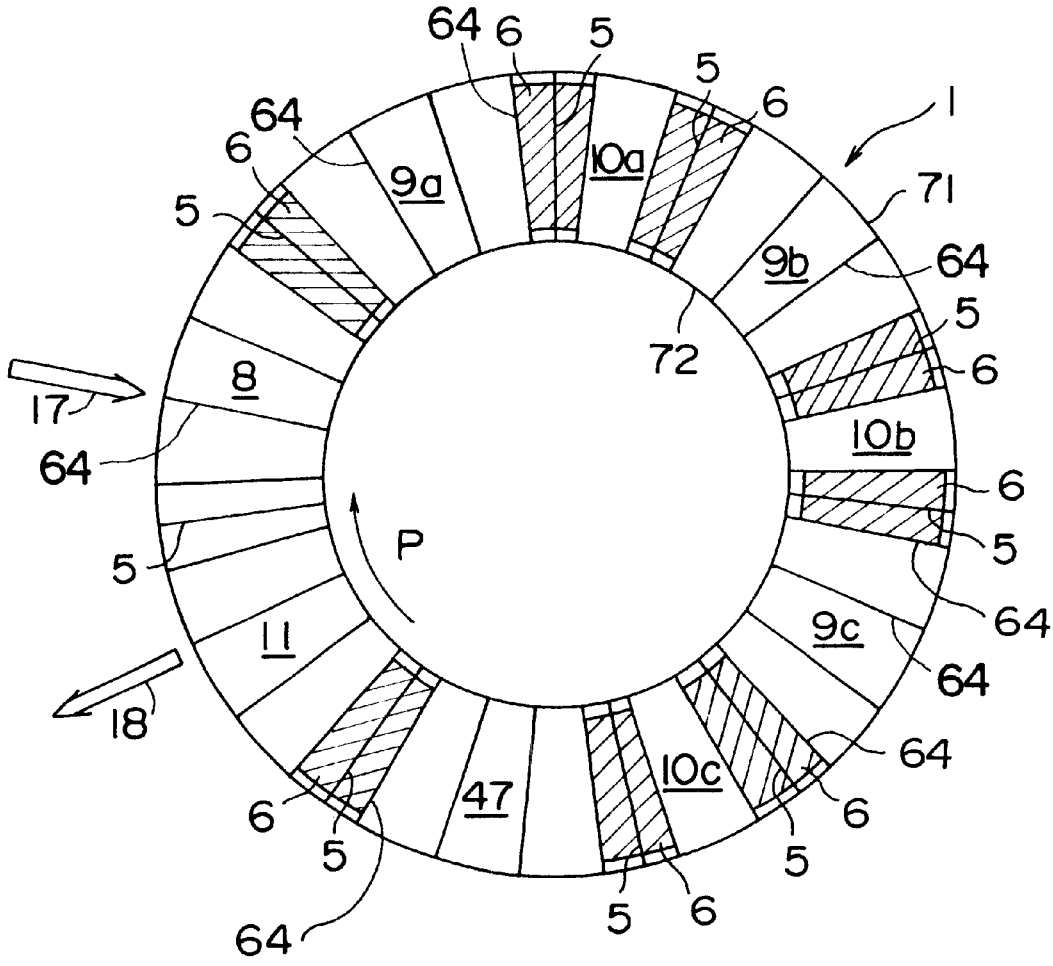
FIG. 2 is a plan view of the circular grate illustrated in FIG. 1.
Figure 3:
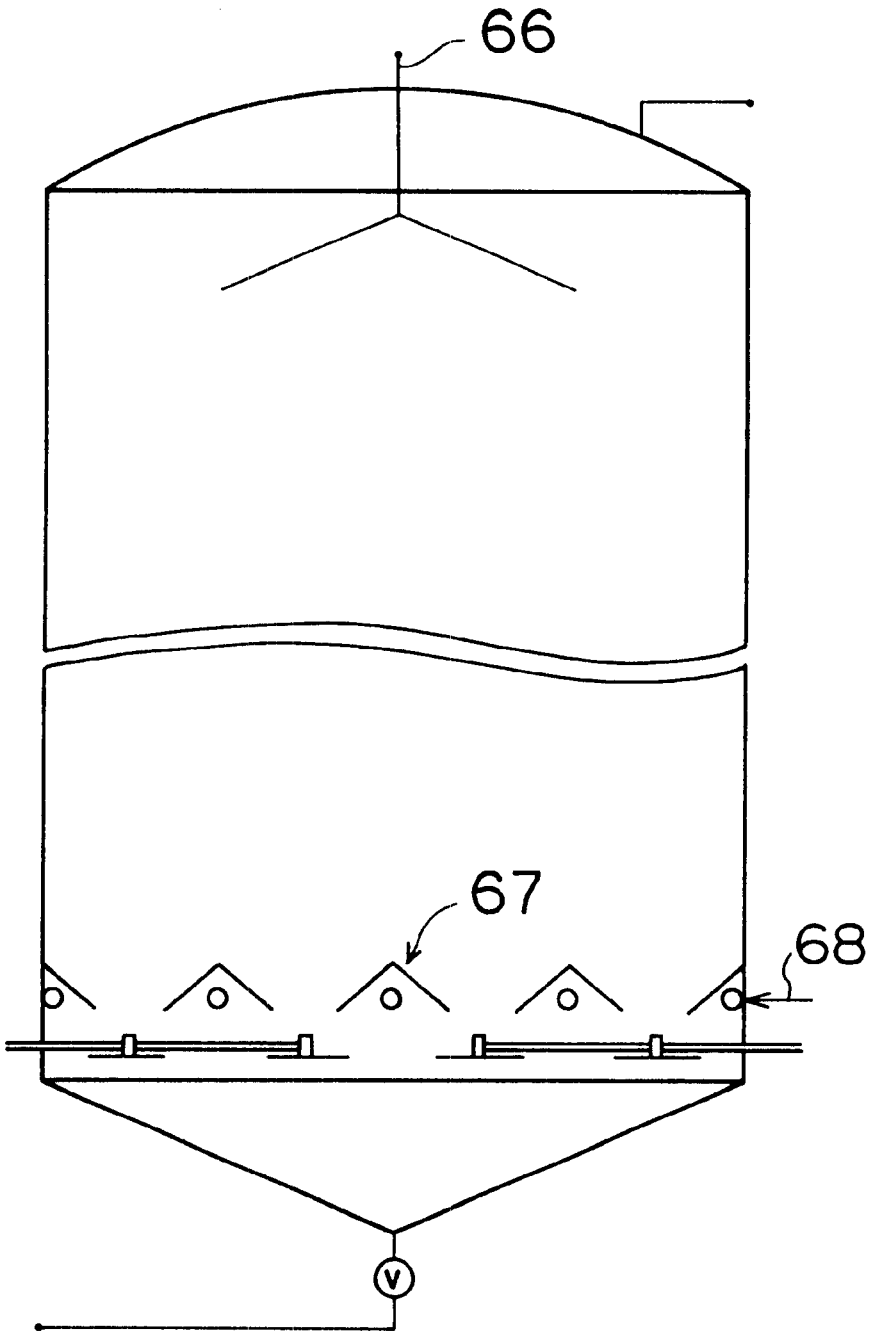
FIG.3 (PRIOR ART)
FIG. 3 is a schematic view illustrating an example of a conventional apparatus for the oxidation treatment of coal.

FIG. 2 is a plan view of the above-described circular grate. An outside wall 71 and an inside wall 72 are fixedly installed so as to be in contact with the outer and inner circumferences of revolving grate 1, respectively. The gaps between outside wall 71 and revolving grate 1 and between inside wall 72 and revolving grate 1 are sealed, for example, with water seals (not shown). Moreover, interzone seals 6 and 6' are disposed between adjacent zones (see FIG. 1). Coal 17 having undergone a dehydration and heating treatment is fed onto revolving grate 1 in feed zone 8, and conveyed through a plurality of oxidation treatment zones 9*a*, 9*b* and 9*c* and a plurality of mixing zones 10*a*, 10*b* and 10*c*. Thereafter, coal 17 is passed through cooling zone 47 and discharged from discharge zone 11 to yield reformed coal 18. The direction of rotation of grate 1 is indicated by the arrow P.

The present invention is further illustrated by the following examples. However, these examples are not to be construed to limit the scope of the invention.

Example 1

Subbituminous coal (Wyoming coal) having an average particle diameter of 2.8 mm was subjected to a dehydration and heating treatment. The resulting coal, which had a temperature of 160° C., was subjected an oxidation treatment by using a circular grate for the oxidation treatment of coal in accordance with the present invention. The heated gas used for this purpose comprised nitrogen gas which had been adjusted to a temperature of 150° C. and an oxygen concentration of 5% by volume. This heated gas was supplied from below a coal bed laid on the grate to a thickness of 150 mm, and passed therethrough for 30 minutes at a flow rate which did not cause fluidization of the coal bed. The spontaneous combustibility of the oxidation-treated coal thus obtained was evaluated by placing the oxidation-treated coal in a vessel maintained at 65° C., introducing dry air thereinto, and measuring the oxygen adsorption rate after the lapse of 30 minutes. The measured oxygen adsorption rate was $30\times10^{-6}$ g $O_2$/g coal/minute, which showed a reduction in the. spontaneous combustibility of coal.

Example 2

Subbituminous coal (Wyoming coal) having an average particle diameter of 2.8 mm was subjected to a dehydration and heating treatment. The resulting coal, which had a temperature of 160° C., was subjected an oxidation treatment by using a circular grate for the oxidation treatment of coal in accordance with the present invention. For this purpose, a heated gas having a temperature of 150° C. was supplied from below a coal bed laid on the grate to a thickness of 150 mm, and passed therethrough for 30 minutes at a flow rate which did not cause fluidization of the coal bed. The oxygen concentration of the heated gas, which varied with the oxidation treatment zone, was adjusted to 5, 7 or 9% by volume as the oxidation treatment zone became farther from the coal feed zone. The oxygen adsorption rate of the oxidation-treated coal thus obtained was measured in the same manner as described in Example 1. As a result, the oxygen adsorption rate was found to be $25\times10^{-6}$ g $O_2$/g coal/minute, which showed a reduction in the spontaneous combustibility of coal.

Example 3

Subbituminous coal (Wyoming coal) having an average particle diameter of 2.8 mm was subjected to a dehydration and heating treatment. The resulting coal, which had a temperature of 160° C., was subjected an oxidation treatment by using a circular grate for the oxidation treatment of coal in accordance with the present invention. For this purpose, a heated gas having a temperature of 120° C. and an oxygen concentration of 5% by volume was supplied from above a coal bed laid on the grate to a thickness of 300 mm, so that the oxidation treatment of the coal was carried out for 30 minutes. The oxygen adsorption rate of the oxidation-treated coal thus obtained was evaluated in the same manner as described in Example 1. As a result, the oxygen adsorption rate was found to be $32\times10^{-6}$ g $O_2$/g coal/minute, which showed a reduction in the spontaneous combustibility of coal.

What is claimed is:

1. A coal reforming process wherein, as one of the coal reforming treatment steps, an oxidation treatment step is carried out on a circular grate separated into a plurality of zones requiring the coal to go through each of the zones in one revolution of the grate; wherein the oxygen concentration of a heated gas used in the oxidizing step is above a minimum of 5% by volume with the time of oxidation limited to between 2–20 minutes in each zone of oxidation such that the oxidation absorption rate is low enough to essentially preclude spontaneous combustion.

2. A coal reforming process according to claim 1 wherein the reaction rate is controlled by independently regulating the temperature, flow rate and oxygen concentration of a gas passed through each of the separated zones.

3. A coal reforming apparatus comprising a circular e, said circular grate being separated into a plurality of zones requiring the coal to go through each of the zones in one revolution of the grate in which the plurality of zones include fixed bed zones, and mixing zones for fluidizing the coal properly between adjacent fixed bed zones, and a line fir supplying a heated gas containing oxygen at a concentration above 5% by volume with the time of oxidation limited to between 2–20 minutes in each zone of oxidation such that the oxidation absorption rate is low enough to essentially preclude spontaneous combustion.

4. A coal reforming apparatus as claimed in claim 3 which further comprises means for independently regulating the temperature, flow rate and oxygen concentration of a gas passed through each of the separated zones.

5. A coal reforming process using a rotatable circular grate equipped with an enclosed space having a plurality of zones of oxidation requiring the coal to go through each of the zones in one revolution of the grate, said process comprising the steps of carrying out the oxidation treatment of coal with a heated gas in a first zone, and then dispersing and mixing the coal uniformly in a second zone, wherein the oxygen concentration of the heated gas is above a minimum of 5% by volume wit the time of oxidation limited to between 2–20 minutes in each zone of oxidation such that the oxidation absorption rate is low enough to essentially preclude spontaneous combustion.

6. A coal reforming process as claimed in claim 5 wherein said circular grate is equipped with two or more enclosed spaces, and said oxidation treatment step and said dispersing and mixing step are repeated two or more times.

7. A coal reforming process as claimed in claim 5 wherein the heated gas is supplied from above the coal bed.

8. A coal reforming process as claimed in claim 6 wherein the heated gas is supplied from above the coal bed.

9. A coal reforming process as claimed in claim 5 wherein the heated gas is supplied from below the coal bed.

10. A coal reforming process as claimed in claim 6 wherein the heated gas is supplied from below the coal bed.

11. A coal reforming process according to claim 1 wherein the oxygen concentration is between 5–9% by volume.

12. A coal reforming process according to claim 3 wherein the oxygen concentration is between 5–9% by volume.

13. A coal reforming process according to claim 5 wherein the oxygen concentration is between 5–9% by volume.

* * * * *